US005449220A

United States Patent [19]

Taylor et al.

[11] Patent Number: 5,449,220

[45] Date of Patent: Sep. 12, 1995

[54] SELECTABLE HEIGHT FOLDING CHAIR APPARATUS

[76] Inventors: Patricia G. Taylor; Robert J. Taylor, both of 212 Avenue DeSuerte, San Marcos, Calif. 92069

[21] Appl. No.: 191,394

[22] Filed: Feb. 2, 1994

[51] Int. Cl.[6] ..... A47C 1/02

[52] U.S. Cl. ..... 297/344.15; 297/344.12; 297/445; 297/16.1

[58] Field of Search ..... 297/344.12, 344.1, 344.15, 297/311, 16.1, 19, 29, 54, 118, 130, 445, 449

[56] References Cited

U.S. PATENT DOCUMENTS

| | | | |
|---|---|---|---|
| 3,716,271 | 2/1973 | Kurz | 297/19 X |
| 4,200,331 | 4/1980 | Uchida | 297/45 |
| 4,613,185 | 9/1986 | Marchesini | 297/39 |
| 4,976,492 | 12/1990 | Ziegler | 297/31 |
| 5,037,116 | 8/1991 | Desanta | 297/39 |
| 5,054,848 | 10/1991 | Liu | 297/16.1 X |
| 5,069,503 | 12/1991 | Martinez | 297/54 |

FOREIGN PATENT DOCUMENTS

| | | | |
|---|---|---|---|
| 219792 | 7/1962 | Austria | 297/344.12 |

*Primary Examiner*—Kenneth J. Dorner
*Assistant Examiner*—Milton Nelson, Jr.

[57] ABSTRACT

A new and improved selectable height chair apparatus includes a chair assembly which includes a plurality of first leg assemblies. A plurality of second leg assemblies are provided, and a plurality of hinge assemblies connect the second leg assemblies to the first leg assemblies. The second leg assemblies are capable of being selectively rotated around the hinge assemblies such that the second leg assemblies can be positioned in a short-legged position wherein the second leg assemblies are oriented at a non-straight angle with respect to the first leg assemblies and such that the second leg assemblies can be positioned in a long-legged position wherein the second leg assemblies are oriented at a straight angle with respect to the first leg assemblies. A plurality of lock assemblies are provided for selectively locking the second leg assemblies in a long-legged position with respect to the first leg assemblies. The first leg assemblies diverge from their respective connections with the seat assembly. A first foot print of the second feet assemblies, when the second leg assemblies are in a long-legged position, is of a first foot print length. A second foot print of the second feet assemblies, when the second leg assemblies are in a short-legged position, is of a second foot print length. The second foot print length is greater than the first foot print length.

7 Claims, 3 Drawing Sheets

SELECTABLE HEIGHT FOLDING CHAIR APPARATUS

BACKGROUND OF THE INVENTION

1. Field of the Invention

The present invention relates generally to chairs and, more particularly, to folding chairs.

2. Description of the Prior Art

Throughout the years, a number of innovations have been developed relating to folding chairs, and the following U.S. patents are representative of some of those innovations: U.S. Pat. Nos. 4,200,331; 4,613,185; 4,976,492; 5,037,116; and 5,069,503. More specifically, U.S. Pat. No. 5,069,503 discloses a portable, collapsible chair that has complete leg units that can selectively be folded under a seat. When the complete leg units are folded under the seat, the chair has no legs and can be used as a stadium or beach seat. On the other hand, when the complete leg units are unfolded and placed in the seat-supporting position, the chair has legs.

Although U.S. Pat. No. 5,069,503 has the advantages described above, there are also a number of disadvantages associated with this device. With this device, there is a choice between a chair with no legs and a chair with legs at a fixed height. Even at a stadium or at a beach, it may be desirable if a chair has legs of a shortened height rather than no legs at all. For example, if the stadium bench is wet, it would be desirable for the seat of the stadium chair to be elevated above a wet bench rather than be placed directly onto a wet bench. This would prevent the seat cushion from getting wet.

Another problem associated with U.S. Pat. No. 5,069,503 is that the support for arm rests is separate and distinct from supports for chair legs. For purposes of simplicity of manufacture and operation, a number of folding chairs are constructed in which arm rests and seats are supported by the same structural supports. Examples of such folding chairs are disclosed in U.S. Pat. Nos. 4,613,185, 4,976,492, and 5,037,116. In this respect, it would be desirable if a folding chair were provided which had selectable length legs and included common structural supports for supporting both arm rests and seats.

Yet another disadvantage associated with the chair disclosed in U.S. Pat. No. 5,069,503 is that each of the four legs of the chair have independent, relatively sharp feet. As a result, when using the chair and legs, all of the weight of the chair and the person sitting in the chair is concentrated on the four relatively sharp feet. Such an arrangement is not practical for soft surfaces such as a sandy beach. In this respect, it would be desirable if a folding chair were provided which included feet having a relatively large surface area to be suitable for use on soft surfaces such as a sandy beach.

U.S. Pat. No. 4,613,185 cited above discloses a typical class of prior art folding chairs in which common supports are used for supporting both arm rests and the seat. In such a folding chair, the common supports are oriented toward each other in a diverging manner from the arm rests to the feet. Because of this divergence, the feet are spaced apart from each other so that the center of gravity of the chair with a person sitting on it will be within the foot print of the chair legs. By having the center of gravity within the foot print of the chair legs, the chair with a person sitting in it is stable and resistant to being readily tipped over. If the legs of such a chair were shortened, then the foot print of the chair legs on the supporting surface would be considerably reduced. As a result, the center of gravity of the chair and the person sitting in the chair may no longer be within the foot print of the chair legs. If such is the case, then the chair with the person sitting in it may be very unstable and easily susceptible to being tipped over. In this respect, it would be desirable if a folding chair were provided which had shortened diverging common arm and seat supports and that is stable and resistant to being tipped over with the shortened legs.

Still other features would be desirable in a selectable height folding chair apparatus. For example, ease of selectability is an important feature. The legs should easily be selectable from a long-legged to a short-legged condition and vice versa. In addition, when the long-legged condition is selected, the lengthened legs should be strongly secured in the long-legged condition.

Thus, while the foregoing body of prior art indicates it to be well known to use folding chairs, the prior art described above does not teach or suggest a selectable height folding chair apparatus which has the following combination of desirable features: (1) provides for the seat of a stadium chair to be elevated above a wet bench rather than be placed directly onto a wet bench; (2) has selectable length legs and includes common structural supports for supporting both arm rests and seats; (3) includes feet having a relatively large surface area to be suitable for use on soft surfaces such as a sandy beach; (4) has shortened diverging common arm rest and seat supports and, at the same time, is stable and resistant to being tipped over with the shortened legs in use; (5) includes legs that are easily selectable from a long-legged to a short-legged condition and vice versa; and (6) has strongly secured lengthened legs when the long-legged condition is selected. The foregoing desired characteristics are provided by the unique selectable height folding chair apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved selectable height chair apparatus which includes a chair assembly which includes a seat assembly, a back assembly connected to the seat assembly, a plurality of first leg assemblies connected to the seat assembly, and a plurality of first feet assemblies connected to the first leg assemblies. The selectable height folding chair apparatus also includes a plurality of second leg assemblies and a plurality of hinge assemblies connecting the second leg assemblies to the first leg assemblies. The second leg assemblies are capable of being selectively rotated around the hinge assemblies such that the second leg assemblies can be positioned in a short-legged position wherein the second leg assemblies are oriented at a non-straight angle with respect to the first leg assemblies. The second leg assemblies are also capable of being selectively rotated around the hinge assemblies such that the second leg assemblies can be positioned in a long-legged position wherein the second leg assemblies are oriented at a straight angle with respect to the first leg assemblies. A plurality of lock assemblies are provided for selectively locking the second leg assemblies in a long-legged position with respect to the first leg assemblies.

A plurality of second feet assemblies are connected to the second leg assemblies. One of the second feet assemblies, a pair of the second leg assemblies, and one of the first feet assemblies form a four-sided foot support for the chair assembly when the second leg assemblies are in a short-legged position.

The first leg assemblies diverge from their respective connections with the seat assembly. A first foot print of the second feet assemblies, when the second leg assemblies are in a long-legged position, is of a first foot print length. A second foot print of the second feet assemblies, when the second leg assemblies are in a short-legged position, is of a second foot print length. The second foot print length is greater than the first foot print length, whereby the second foot print length provides increased stability to the chair assembly when a person is seated in the chair assembly in the short-legged position. The respective second feet assemblies and the respective second leg assemblies are preferably formed as an integrated, unitary U-shaped structure.

The first leg assemblies extend above the seat assembly. A pair of arm rest assemblies is supported by the extended first leg assemblies. The chair assembly is a folding chair assembly and includes a seat assembly and a back assembly that is connected to the seat assembly by a hinge. A plurality of first leg assemblies are connected to the seat assembly by hinges, and a plurality of first feet assemblies are connected to the first leg assemblies. The first leg assemblies extend above the seat assembly when the chair assembly is in an unfolded condition, and a pair of arm rest assemblies are supported by the extended first leg assemblies by hinge assemblies.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved selectable height folding chair apparatus which has all of the advantages of the prior art and none of the disadvantages.

It is another object of the present invention to provide a new and improved selectable height folding chair apparatus which may be easily and efficiently manufactured and marketed.

It is a further object of the present invention to provide a new and improved selectable height folding chair apparatus which is of durable and reliable construction.

An even further object of the present invention is to provide a new and improved selectable height folding chair apparatus which is susceptible of a low cost of manufacture with regard to both materials and labor, and which accordingly is then susceptible of low prices of sale to the consuming public, thereby making such selectable height folding chair apparatus available to the buying public.

Still yet a further object of the present invention is to provide a new and improved selectable height folding chair apparatus which provides for the seat of a stadium chair to be elevated above a wet bench rather than be placed directly onto a wet bench.

Still another object of the present invention is to provide a new and improved selectable height folding chair apparatus that has selectable length legs and includes common structural supports for supporting both arm rests and seats.

Yet another object of the present invention is to provide a new and improved selectable height folding chair apparatus which includes feet having a relatively large surface area to be suitable for use on soft surfaces such as a sandy beach.

Even another object of the present invention is to provide a new and improved selectable height folding chair apparatus that has shortened diverging common arm rest and seat supports and, at the same time, is stable and resistant to being tipped over with the shortened legs in use.

Still a further object of the present invention is to provide a new and improved selectable height folding chair apparatus which includes legs that are easily selectable from a long-legged to a short-legged condition and vice versa.

Yet another object of the present invention is to provide a new and improved selectable height folding chair apparatus that has strongly secured lengthened legs when the long-legged condition is selected.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
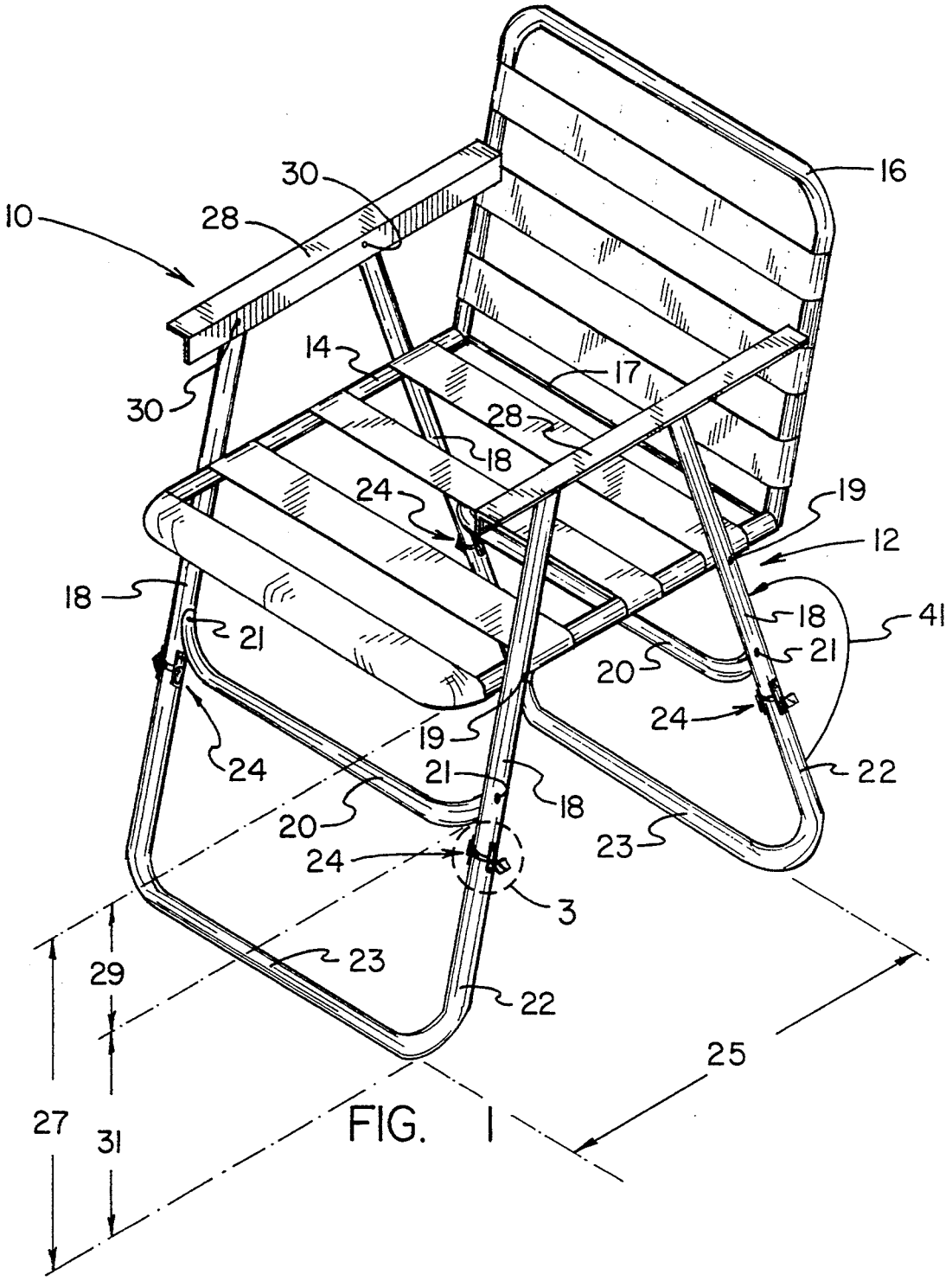
FIG. 1 a perspective view showing a preferred embodiment of the selectable height folding chair apparatus of the invention in a lengthened leg condition.

With reference to the drawings, a new and improved selectable height folding chair apparatus embodying the principles and concepts of the present invention will be described.

Turning to FIGS. 1–4, there is shown an exemplary embodiment of the selectable height folding chair apparatus of the invention generally designated by reference numeral 10. In its preferred form, selectable height folding chair apparatus 10 includes a chair assembly 12 which includes a scat assembly 14, a back assembly 16 connected to the scat assembly 14, a plurality of first leg assemblies 18 connected to the scat assembly 14, and a plurality of first foot assemblies 20 connected to the first leg assemblies 18. The selectable height folding chair apparatus 10 also includes a plurality of second leg assemblies 22 and a plurality of hinge assemblies 24 connecting the second leg assemblies 22 to the first leg assemblies 18. The second leg assemblies 22 arc capable of being selectively rotated around the hinge assemblies 24 such that the second leg assemblies 22 can be positioned in a short-legged position wherein the second leg assemblies 22 arc oriented at a non-straight angle 39 with respect to the first leg assemblies 18. The second leg assemblies 22 arc also capable of being selectively rotated around the hinge assemblies 24 such that the second leg assemblies 22 can be positioned in a long-legged position wherein the second leg assemblies 22 are oriented at a straight angle 41 with respect to the first leg assemblies 18. A plurality of lock assemblies 26 arc provided for selectively locking the second leg assemblies 22 in a long-legged position with respect to the first leg assemblies 18.

Figure 2:
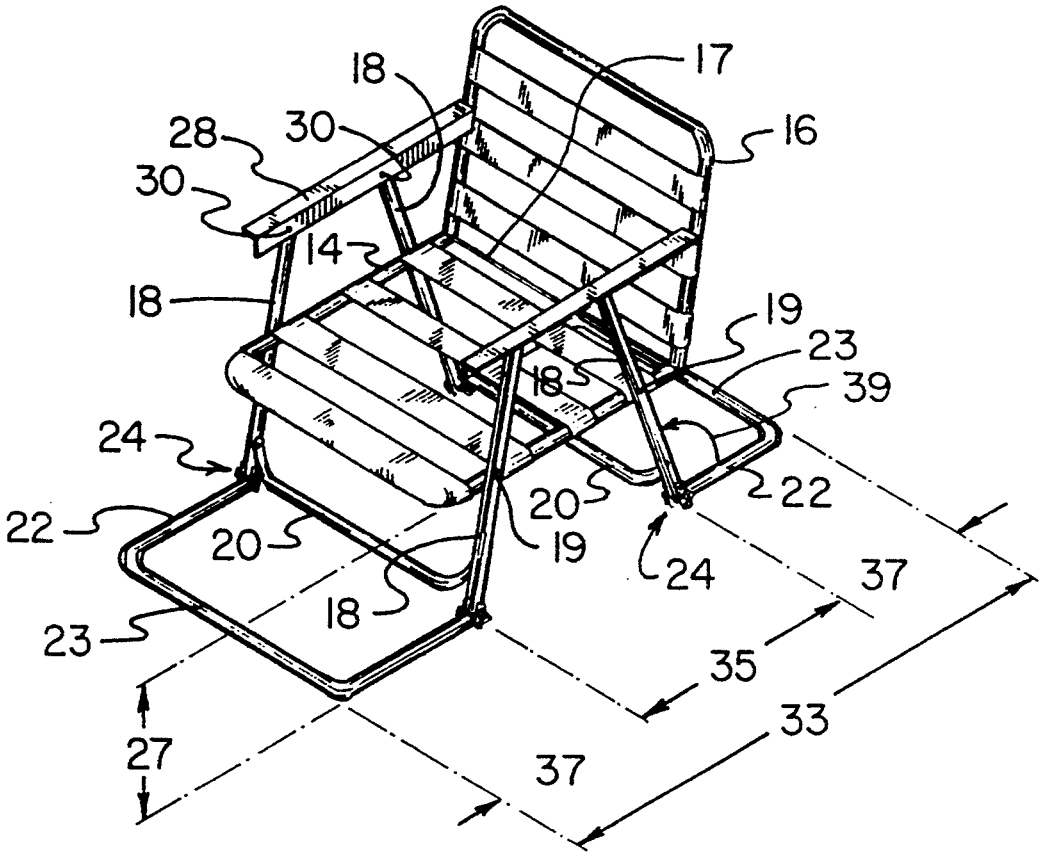
FIG. 2 is a perspective view of the embodiment of the invention shown in FIG. 1 shown in the alternate short-legged condition.

A plurality of second feet assemblies 23 are connected to the second leg assemblies 22. As shown in FIG. 2, one of the second feet assemblies 23, a pair of the second leg assemblies 22, and one of the first feet assemblies 20 form a four-sided foot support for the chair assembly 12 when the second leg assemblies 22 are in a short-legged position. The four-sided foot support for the chair assembly 12 provides a foot support which has a relatively large surface area which is especially useful on soft surfaces such as a sandy beach.

The first leg assemblies 18 diverge from their respective connections with the seat assembly 14. A first foot print of the second feet assemblies 23, when the second leg assemblies 22 are in a long-legged position, is of a first foot print length 25. A second foot print of the second feet assemblies 23, when the second leg assemblies 22 are in a short-legged position, is of a second foot print length 33. In accordance with the invention, The second foot print length 33 is greater than the first foot print length 25, whereby the second foot print length 33 provides increased stability to the chair assembly 12 when a person is seated in the chair assembly 12 in the short-legged position. The respective second feet assemblies 23 and the respective second leg assemblies 22 are preferably formed as an integrated, unitary U-shaped structure.

The first leg assemblies 18 extend above the seat assembly 14. A pair of arm rest assemblies 28 is supported by the extended first leg assemblies 18. More specifically, The chair assembly 12 is a folding chair assembly and includes a seat assembly 14 and a back assembly 16 that is connected to the seat assembly 14 by a hinge. A plurality of first leg assemblies 18 are connected to the seat assembly 14 by hinges, and a plurality of first feet assemblies 20 are connected to the first leg assemblies 18. More specifically, the seat assembly 14 is connected to the back assembly 16 by hinge pin 17. The first leg assemblies 18 are connected to the seat assembly 14 by hinge assemblies 19. In contrast, the first feet assemblies 20 are rigidly connected to the first leg assemblies 18 by rivets 21. The first leg assemblies 18 extend above the seat assembly 14 when the chair assembly 12 is in an unfolded condition, and a pair of arm rest assemblies 28 are supported by the extended first leg assemblies 18 by hinge assemblies 30.

When the chair assembly 12 is unfolded in a well known way so that a person can sit on the seat assembly 14, the selectable height folding chair apparatus 10 of the invention can be arranged so that, as shown in FIG. 1, the legs are in a long-legged position. More specifically, the first leg assemblies 18 and the second leg assemblies 22 are arranged in a straight line (has straight angle 41) so that the effective length of the respective chair legs is the sum of the respective lengths of the first leg assemblies 18 and the second leg assemblies 22. The first leg assemblies 18 diverge from their respective hinged connections 19 with the seat assembly 14. The foot print of the second feet assemblies 23 is of a first foot print length 25 when the first leg assemblies 18 and the second leg assemblies 22 are in the long-legged position as shown in FIG. 1. In addition, the height above the ground of the seat assembly 14 of the selectable height folding chair apparatus 10 shown in FIG. 1 is equal to the long-legged height 27 which is the sum of the vertical distance 29 from the seat assembly 14 to the first feet assemblies 20 and the vertical distance 31 from the first feet assemblies 20 to the second feet assemblies 23.

On the other hand, the height above the ground of the seat assembly 14 of the selectable height folding chair apparatus 10 of the invention can also be arranged in the short-legged position shown in FIG. 2. In the short-legged position, the height 27 of the apparatus 10 is equal to the vertical distance from the seat assembly 14 to the first feet assemblies 20. In addition, the foot print of the selectable height folding chair apparatus 10 of the invention shown in FIG. 2 in the short-legged position is the second foot print length 33 which is equal to the sum of the distance 35 between the ends of the first leg assemblies 18 and the respective lengths 37 between the hinge assemblies 24 and the second feet assemblies 23. The second foot print length 33 is greater than the first foot print length 25.

To keep the first leg assemblies 18 in a straight line angle 41 with the second leg assemblies 22 when the selectable height folding chair apparatus 10 of the invention is in the long-legged position, the lock assemblies 26 can be made from a variety of well known leg-locking constructions. For example, a sleeve can jacket a portion of both the first leg assemblies 18 and the second leg assemblies 22 when they are in the straight, long-legged position. Alternatively, the lock assemblies 26 can include well known sliding bolt constructions.

Figure 3:
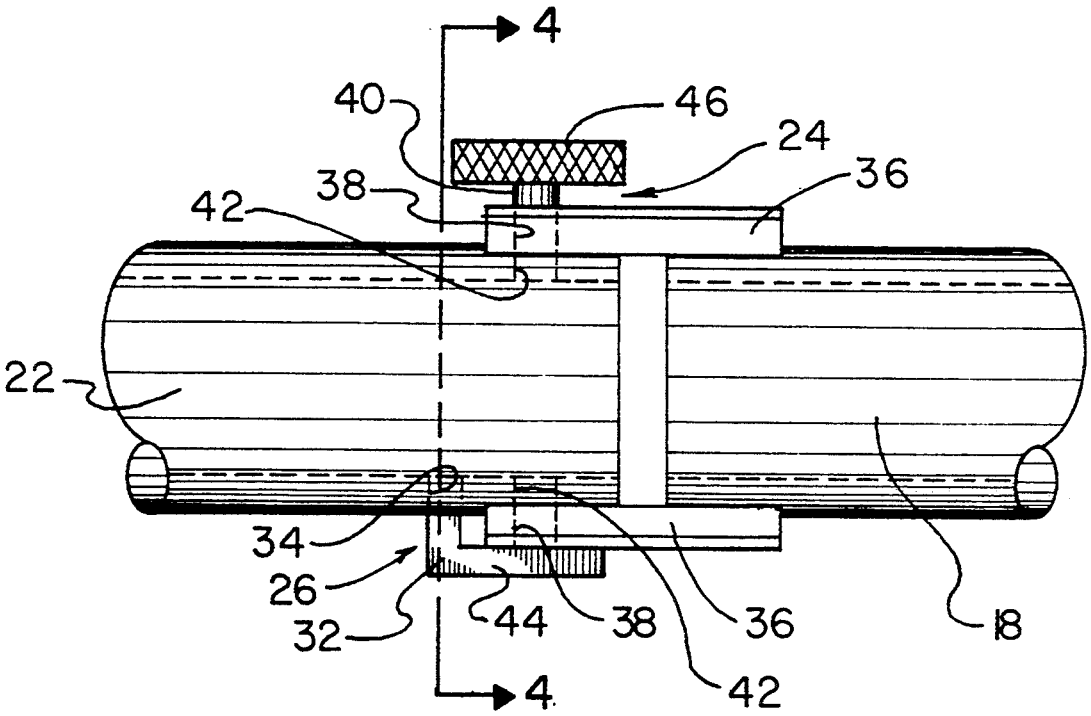
FIG. 3 is an enlarged side view of the circled region 3 in FIG. 1 showing a hinge and lock portion for connecting two leg portions together.
Figure 4:
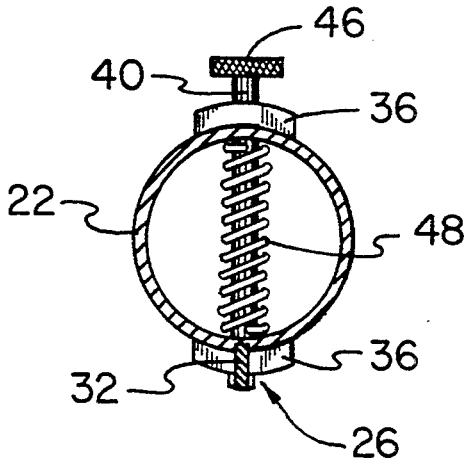
FIG. 4 is a cross-sectional view of the hinge and lock portion shown in FIG. 3 taken along line 4—4 of FIG. 3.

Still alternatively, as shown in FIGS. 3 and 4, the lock assemblies 26 can include respective locking pins 32, supported by respective second leg assembly 22 that are placed in registration with respective pin-receiving holes 34 in the respective second leg assemblies 22. More specifically, hinge brackets 36 are fixed to respective first leg assemblies 18 by being welded thereto. The hinge brackets 36 include first hinge-pin-receiving apertures 38. A hinge pin 40 is placed through respective first hinge-pin-receiving apertures 38 and through complementary second hinge-pin-receiving apertures 42 in the respective second leg assemblies 22. By being rotated around the respective hinge pins 40, the second leg assemblies 22 can be moved from the short-legged position to the long-legged position and vice versa.

When the second leg assemblies 22 are rotated away from the first leg assemblies 18, as shown in FIG. 2, in the short-legged position, the second leg assemblies 22 rotate around the respective hinge pins 40. In the short-legged position, the second leg assemblies 22 are oriented with respect to the first leg assemblies 18 at a non-straight angle 39. With the second leg assemblies 22 in the short-legged position, the locking pin 32 cannot be placed in registration with the respective pin-receiving holes 34 in the second leg assemblies 22. Therefore, when the selectable height folding chair apparatus 10 of the invention is in the short-legged position, the second leg assemblies 22 are not locked into position with respect to the first leg assemblies 18.

On the other hand, when the selectable height folding chair apparatus 10 of the invention is in the long-legged position, that is when the first leg assemblies 18 and the second leg assemblies 22 are in a straight line angle 41, the respective locking pins 32 are capable of being placed within the complementary pin-receiving holes 34 in the second leg assemblies 22. More specifically, each locking pin 32 is connected to a bridge element 44 which is connected to a distal end of the hinge pin 40. The proximal end of the hinge pin 40 includes a handle 46 which is in the form of a push button 46. One end of a spring 48 is connected to the hinge pin 40. The spring 48 biases a respective locking pin 32 into a respective pin-receiving hole 34 of the respective second leg assembly 22. When the handle 46 is pressed inward toward the distal end of the hinge pin 40, the spring 48 is compressed, and the locking pin 32 is lifted out of the pin-receiving hole 34 such that the selectable height folding chair apparatus 10 of the invention is released from the long-legged position. After rotating the second leg assemblies 22 around the first leg assemblies 18, the handle 46 is released, and the second leg assemblies 22 are free to rotate so that the first leg assemblies 18 are in the short-legged position.

To change from the short-legged position to the long-legged position, the second leg assemblies 22 are rotated toward the respective first leg assemblies 18 so that they approach the straight-line orientation. Just before the straight-line orientation is obtained, the handle 46 is pressed to move the respective locking pins 32 distally with respect to the respective second leg assemblies 22. Once the first leg assemblies 18 and the second leg assemblies 22 are in the straight-line position at straight angle 41, the locking pin 32 is in registration above the pin-receiving hole 34. For each lock assembly 26, then the handle 46 is released, and the spring 48 urges the locking pin 32 into the pin-receiving hole 34 which is in registration therewith, whereby the first leg assemblies 18 and the second leg assemblies 22 are locked into the straight-line, long-legged position.

The components of the selectable height folding chair apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved selectable height folding chair apparatus that is low in cost, relatively simple in design and operation, and which may advantageously be used to provide for the seat of a stadium chair to be elevated above a wet bench rather than be placed directly onto a wet bench. With the invention, a selectable height folding chair apparatus is provided which has selectable length legs and includes common structural supports for supporting both arm rests and seats. With the invention, a selectable height folding chair apparatus is provided which includes feet having a relatively large surface area to be suitable for use on soft surfaces such as a sandy beach. With the invention, a selectable height folding chair apparatus is provided which has shortened diverging common arm rest and seat supports and, at the same time, is stable and resistant to being tipped over with the shortened legs in use. With the invention, a selectable height folding chair apparatus is provided which includes legs that are easily selectable from a long-legged to a short-legged condition and vice versa. With the invention, a selectable height folding chair apparatus is provided which has strongly secured lengthened legs when the long-legged condition is selected.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved selectable height chair apparatus, comprising:

a chair assembly which includes a seat assembly, a back assembly connected to said seat assembly, a plurality of first leg assemblies connected to said seat assembly, and a plurality of first feet assemblies connected to said first leg assemblies, a plurality of second leg assemblies, a plurality of hinge assemblies for connecting said second leg assemblies to said first leg assemblies, wherein said second leg assemblies are capable of being selectively rotated around said hinge assemblies such that said second leg assemblies can be positioned in a short-legged position wherein said second leg assemblies are oriented at a non-straight angle with respect to said first leg assemblies, and wherein said second leg assemblies are capable of being selectively rotated around said hinge assemblies such that said second leg assemblies can be positioned in a long-legged position wherein said second leg assemblies are oriented at a straight angle with respect to said first leg assemblies, a plurality of lock assemblies for selectively connecting between said first leg assemblies and said second leg assemblies for selectively locking said second leg assemblies in said long-legged position with respect to said first leg assemblies, and a plurality of second feet assemblies connected to said second leg assemblies, wherein one of said second feet assemblies, a pair of said second leg assemblies, and one of said first feet assemblies form a four-sided foot support for said chair assembly when said second leg assemblies are in said short-legged position.

2. The apparatus described in claim 1 wherein:

said first leg assemblies diverge from their respective connections with said seat assembly, a first foot print of said second feet assemblies when said second leg assemblies are in said long-legged position is of a first foot print length, a second foot print of said second feet assemblies when said second leg assemblies are in said short-legged position is of a second foot print length, and said second foot print length is greater than said first foot print length, whereby said second foot print length provides increased stability to said chair assembly when a person is seated in said chair assembly.

3. The apparatus described in claim 1 wherein said respective second feet assemblies and said respective second leg assemblies are formed as an integrated, unitary U-shaped structure.

4. The apparatus described in claim 1 wherein said first leg assemblies extend above said seat assembly.

5. The apparatus described in claim 4, further including:

a pair of arm rest assemblies supported by said extended first leg assemblies.

6. The apparatus described in claim 1 wherein said chair assembly is a folding chair assembly and includes:

said seat assembly, said back assembly hingedly connected to said seat assembly, and said plurality of first leg assemblies hingedly connected to said seat assembly.

7. The apparatus described in claim 6 wherein said first leg assemblies extend above said seat assembly when said chair assembly is in an unfolded condition and, further including:

a pair of arm rest assemblies supported by said extended first leg assemblies by hinge assemblies.

* * * * *